US009476679B2

(12) United States Patent
Hafer

(10) Patent No.: US 9,476,679 B2
(45) Date of Patent: Oct. 25, 2016

(54) ULTRA LIGHT BAR ARMOR

(76) Inventor: Thomas Frederick Hafer, Arlington, VA (US)

( * ) Notice: Subject to any disclaimer, the term of this patent is extended or adjusted under 35 U.S.C. 154(b) by 130 days.

(21) Appl. No.: 13/603,736

(22) Filed: Sep. 5, 2012

(65) Prior Publication Data

US 2015/0020678 A1 Jan. 22, 2015

Related U.S. Application Data

(60) Provisional application No. 61/573,449, filed on Sep. 6, 2011.

(51) Int. Cl.
*F41H 5/02* (2006.01)

(52) U.S. Cl.
CPC ..... *F41H 5/026* (2013.01)

(58) Field of Classification Search
CPC ..... F41H 5/0492; F41H 7/02; F41H 5/026; F41H 5/023; F41H 7/00; F41H 11/00; F41H 7/04; F41H 5/02
USPC ..... 89/36.03, 36.04, 36.08, 36.09, 929, 920
See application file for complete search history.

(56) References Cited

U.S. PATENT DOCUMENTS 7,827,900 B2 * 11/2010 Beach et al. ..... 89/36.17
7,882,776 B2 * 2/2011 Medwell et al. ..... 89/36.02
8,132,495 B2 * 3/2012 Joynt ..... 89/36.08
8,316,753 B2 * 11/2012 Beach et al. ..... 89/36.17
2008/0257141 A1 * 10/2008 Medwell et al. ..... 89/36.02
2009/0266226 A1 * 10/2009 Beach et al. ..... 89/36.02
2009/0266227 A1 * 10/2009 Farinella et al. ..... 89/36.02
2010/0206158 A1 * 8/2010 Neethling ..... 89/36.02
2010/0288114 A1 * 11/2010 Soukos ..... 89/36.02
2011/0067561 A1 * 3/2011 Joynt ..... 89/36.02
2011/0113952 A1 * 5/2011 Rosenwasser et al. ..... 89/36.02
2011/0120294 A1 * 5/2011 Beach et al. ..... 89/36.02
2011/0232472 A1 * 9/2011 Kellner et al. ..... 89/36.08
2012/0137866 A1 * 6/2012 Gonard et al. ..... 89/36.08
2012/0144986 A1 * 6/2012 Gonard et al. ..... 89/36.01
2012/0291616 A1 * 11/2012 Andrewartha et al. ..... 89/36.02

* cited by examiner

*Primary Examiner* — Joshua Freeman
(74) *Attorney, Agent, or Firm* — Capitol City TechLaw, PLLC; Samuel P. Burkholder

(57) ABSTRACT

Bar armor currently provides a means of providing partial protection of vehicles and structures against certain types of Rocket Propelled Grenades (RPGs). However, the individual bars must provide enough strength to cut through or deform the outer ogive of an RPG and cause electrical contact with the inner ogive. This in turn imposes constraints on the overall effectiveness of the system and how light it can be made. These constraints can be eased by providing cross-attachments for the bars, provided that the cross-attachments themselves are mutually supporting and of low enough density and sufficient frangibility to avoid detonating the RPG when they are struck by the RPG nosepiece, which contains a piezoelectric element that causes the fuse of the RPG to function. Through this means, bar armor can be made lighter, more effective, and easier to see through.

6 Claims, 7 Drawing Sheets

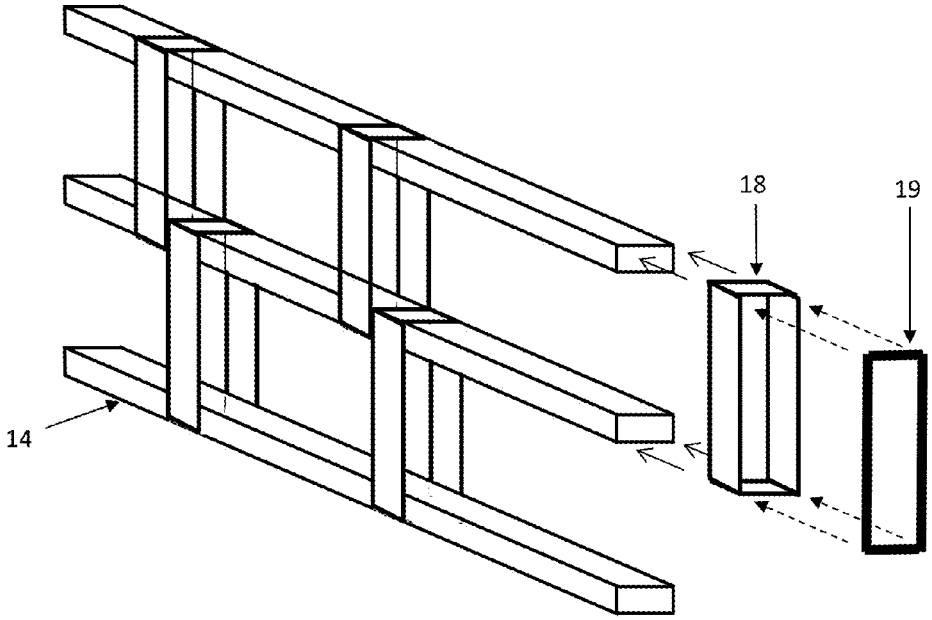
FIG. 11
FIG. 12a
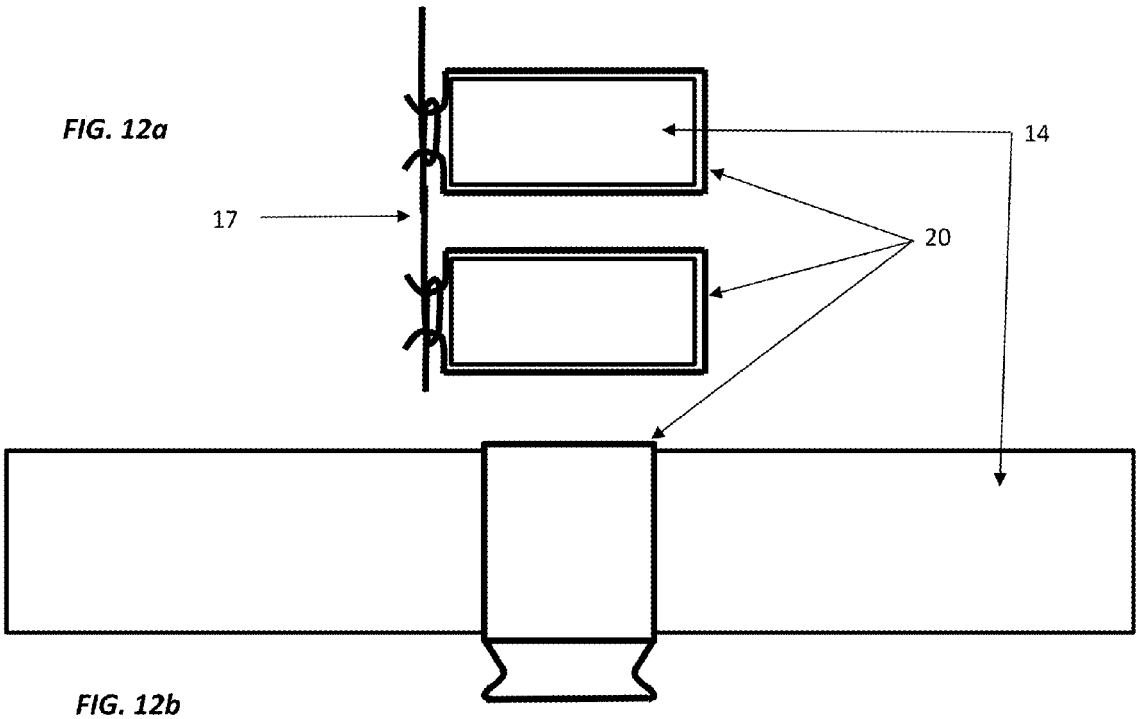
FIG. 12b

ULTRA LIGHT BAR ARMOR

RELATED APPLICATIONS

This patent application claims priority over Provisional Patent Application Ser. No. 61/573,449 filed on 6 Sep. 2011, incorporated herein by reference.

FIELD OF THE INVENTION

This invention generally relates to protection of vehicles and structures from Rocket Propelled Grenades. More particularly, it relates to reducing the weight and improving the effectiveness of bar armor by inhibiting bar separation by means of low density frangible connections between the bars.

BACKGROUND OF THE INVENTION

Rocket Propelled Grenades (RPGs) have been employed since World War II against armored vehicles and fortifications. They are cheap, effective, and difficult to counter. Currently, millions of these weapons are used by insurgent and guerilla forces, as well as regular forces in many countries. RPGs can penetrate as much as a foot of steel armor, so it is not practical to use steel for RPG protection on most vehicles because of the weight. To provide at least partial protection against these weapons, bar or slat armor has been developed, and is in use on a number of military vehicles. Bar armor works by exploiting a design feature in the RPG, namely that causing the inner and outer ogives (the hollow conical forward members of the RPG warhead) to become electrically connected causes the piezoelectric nose element to become short circuited, thus denying electrical power to the initiating element at the rear of the RPG. When an RPG passes between the bars of bar armor at high speed without the forward nose element hitting a bar, the outer ogive is crushed into the inner ogive, a short circuit is established, and the RPG is dudded. Bar and slat armor is much lighter than steel would be, but is still relatively heavy when applied to large areas of an armored vehicle, adding hundreds or even thousands of pounds. For many applications, lighter solutions are desired, as well as improved effectiveness and visibility through the bars.

Currently, bar armor is typically composed of aluminum bars 30 to 40 inches long, each separated by about 3 inches, with a square cross section about ½ inch on a side. Slat armor is similar but with a cross section more typically ¼ inch across by 1 or 2 inches in depth. With low cost materials, these dimensions cannot easily be reduced because the resultant low lateral strength allows the bars or slats to be pushed apart by the RPG ogive without inflicting sufficient damage. However, it would be possible to reduce these dimensions if the bars could be constrained laterally without introducing structural members that could themselves provide sufficient impact to the piezoelectric element to set off the RPG.

SUMMARY OF THE INVENTION

It is therefore an object of the present invention to provide an improved bar armor solution for protection against RPGs by inhibiting lateral spreading of the bars through the use of low density frangible cross-attachment members between the bars that provide sufficient strength to prevent bar spreading and are also of low enough aereal density and of sufficient frangibility to avoid detonation of the RPG if the cross-attachment members are struck by the nosepiece of the RPG, thus allowing thinner bars to be used than would otherwise be possible.

It is a further object of the present invention to provide a means of reducing the weight of bar armor.

It is a further object of the present invention to provide a means of increasing the effectiveness of bar armor.

It is a further object of the present invention to provide a means of improving the visibility through bar armor.

It is a further object of the present invention to reduce the cost of bar armor systems.

BRIEF DESCRIPTION OF THE DRAWINGS

This foregoing and other features and advantages of this invention will be apparent from the following detailed description of the invention as illustrated in the accompanying drawings, in which:

FIG. 7 is a front view of an RPG engaging bar armor showing the bars being spread laterally by the ogive of the RPG pushing through.

FIG. 11 is a depiction of the use of bands or loops as cross-attachments for the bars.

FIG. 12 is a depiction of a clip that goes on the bar to make cross-attachment easier.

DETAILED DESCRIPTION OF THE INVENTION

The present invention improves the performance of bar armor against RPGs by inhibiting the spreading of the bars, thus allowing smaller cross section bars to be used. This can result in lighter weight, improved performance, improved visibility through the bars, and lower cost.

To understand how this works, it is first necessary to understand the operation of an RPG and of bar armor.

RPG and Bar Armor Operation

Figure 1:
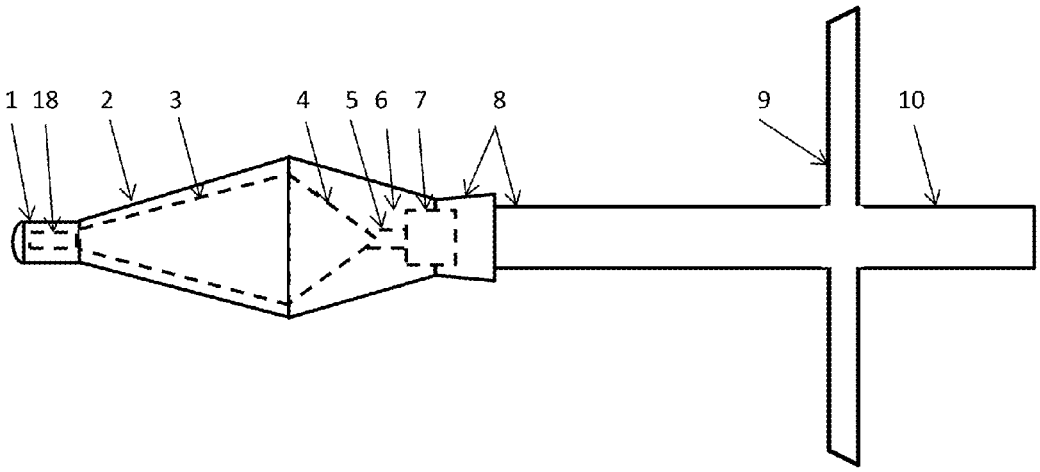
FIG. 1 is a drawing of a Rocket Propelled Grenade (RPG) with critical external and internal elements depicted.

Referring to FIG. 1, the RPG is about 37 inches long and the warhead has a maximum diameter of about 3½ inches. The nosepiece 1 is approximately 1 inch in diameter and contains a piezoelectric crystal 18 that produces a voltage when it strikes a target. Behind that are the hollow aluminum outer ogive 2 and the hollow aluminum inner ogive 3. These provide standoff to allow the warhead to function optimally. The warhead consists of the hollow copper shaped charge liner 4, the conductive stem 5, the explosive 6, and the initiating fuse 7. Behind these are the flight motor 8 that provides thrust during the flight of the RPG, the deployable fins 9 that provide aerodynamic stability, and the launch motor 10 that ejects the RPG from its launcher.

Figure 2:
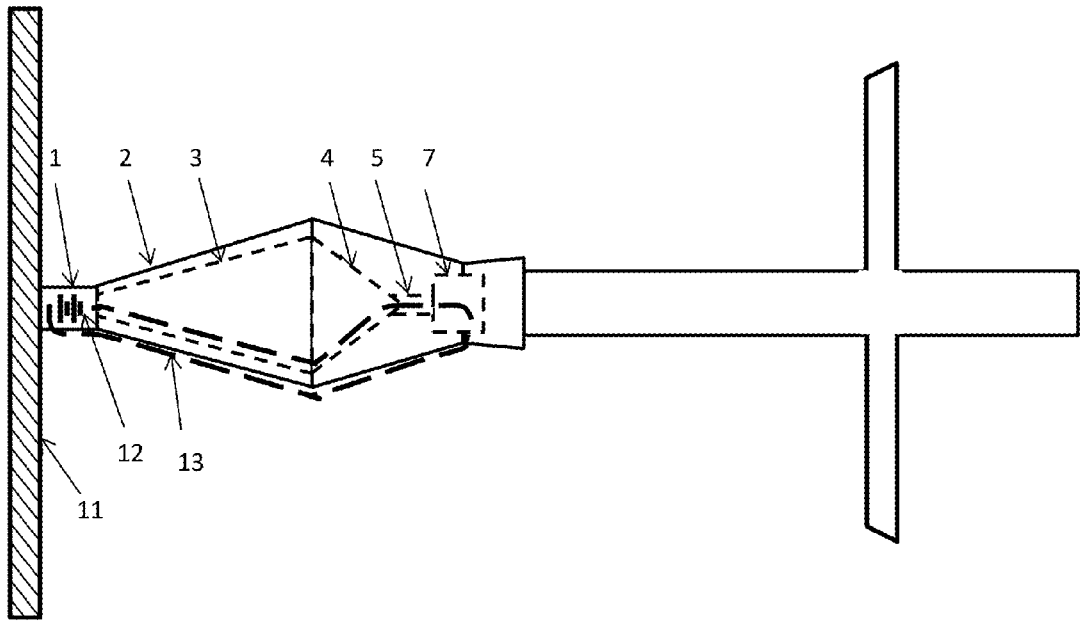
FIG. 2 is a drawing of the normal electrical path for the fuse of the RPG when a target is struck.

Referring to FIG. 2, in normal operation, when the RPG strikes a target 11, the piezoelectric crystal in the nosepiece 1 generates a voltage 12 that is conducted to the initiating fuse 7 via a circuit path 13 from the positive terminal of the piezoelectric crystal to the outer ogive 2 and aluminum body of the RPG warhead, through the fuse 7, and returns via the conducting stem 5, the copper shaped charge liner 4, and the inner ogive 3, to the negative terminal of the piezoelectric crystal.

Figure 3:
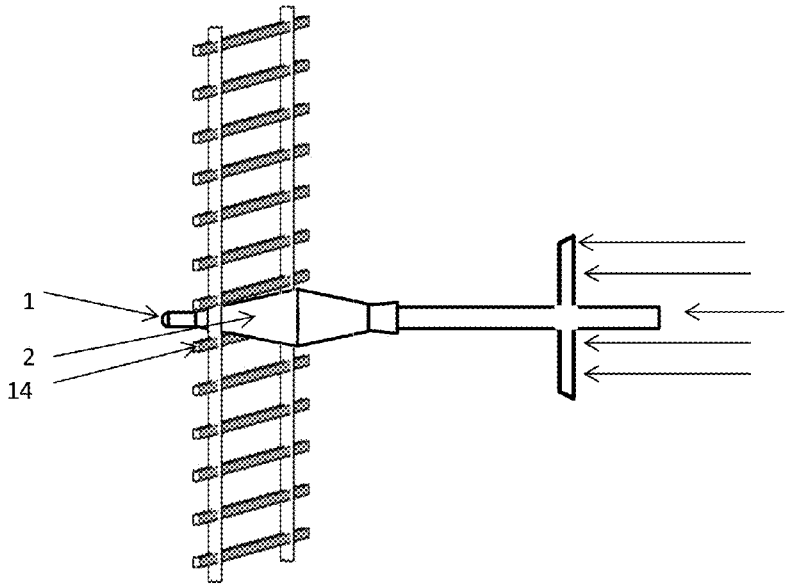
FIG. 3 is a depiction of an RPG engaging bar armor showing the bars about to engage the ogive of the RPG.
Figure 4:
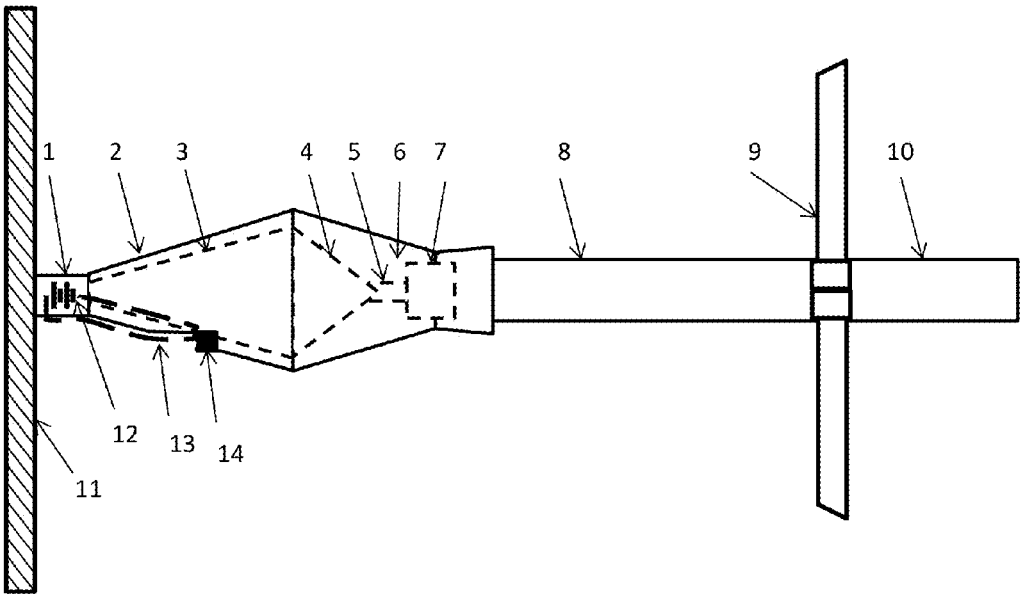
FIG. 4 is a is a drawing of the disrupted electrical path when a bar electrically connects the outer and inner ogives of the RPG.

Referring to FIG. 3, when an RPG encounters a bar armor assembly and the RPG nosepiece 1 does not strike a bar, the outer ogive 2 will encounter a bar and the bar will distort or cut through the outer ogive and establish electrical contact with the inner ogive, thus dudding the round as per FIG. 4.

Referring to FIG. 4, when bar armor 14 cuts through the outer ogive 2 and bridges to the inner ogive 3, the conductive path 13 is short-circuited before it can reach the initiating fuse 7, so the RPG is dudded and cannot be detonated. The bar may be part of the conductive path.

Figure 5:
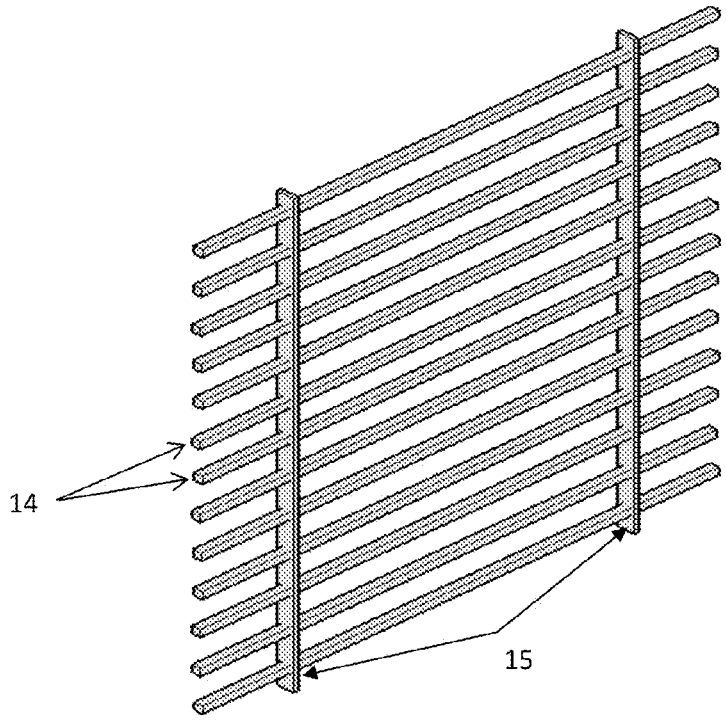
FIG. 5 is a depiction of a typical bar armor system.

FIG. 5 shows a typical bar armor assembly with bars 14 typically made of high grade, corrosion resistant aluminum such as 7075 with square cross sections roughly ½"×½" and aluminum bar supports 15 typically ¼"×1" in cross section. The vertical space between each bar is about 3 inches such that the RPG cannot pass between the bars without contacting them. The assembly is typically 3 feet to 4 feet wide and 3 feet to 4 feet tall. This assembly is attached to the vehicle via cantilevered arms typically 10" long in order to provide sufficient standoff from the vehicle including protrusions such as door handles, mirrors, etc. The effectiveness of bar armor is dependent on two things. First, the bars must be strong enough to cause the outer ogive 2 of the RPG to become electrically shorted to the inner ogive 3. This can occur either by cutting the outer ogive and connecting it to the inner ogive via the bar, as per FIG. 4 or by deforming the outer ogive into contact with the inner ogive. Second, the frontal area presented by the bars 14 to the nosepiece 1 of the RPG must be as small as possible because a strike of the nosepiece on the bar will shock the piezoelectric crystal and cause the RPG to detonate.

Figure 6:
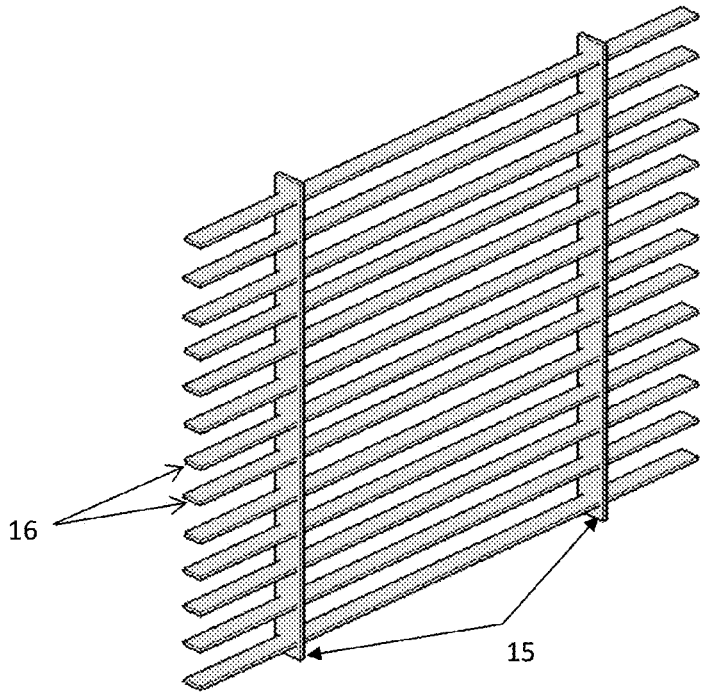
FIG. 6 is a depiction of a variant of bar armor that replaces the bars with thinner but deeper slats.

FIG. 6 shows a variation of a bar armor assembly in which the bars are replaced by slats 16 that perform a function similar to the bars but have a flattened cross section more typically 1"-2" deep×¼" tall. This is a form of bar armor but is sometimes referred to as slat armor.

Figure 7:
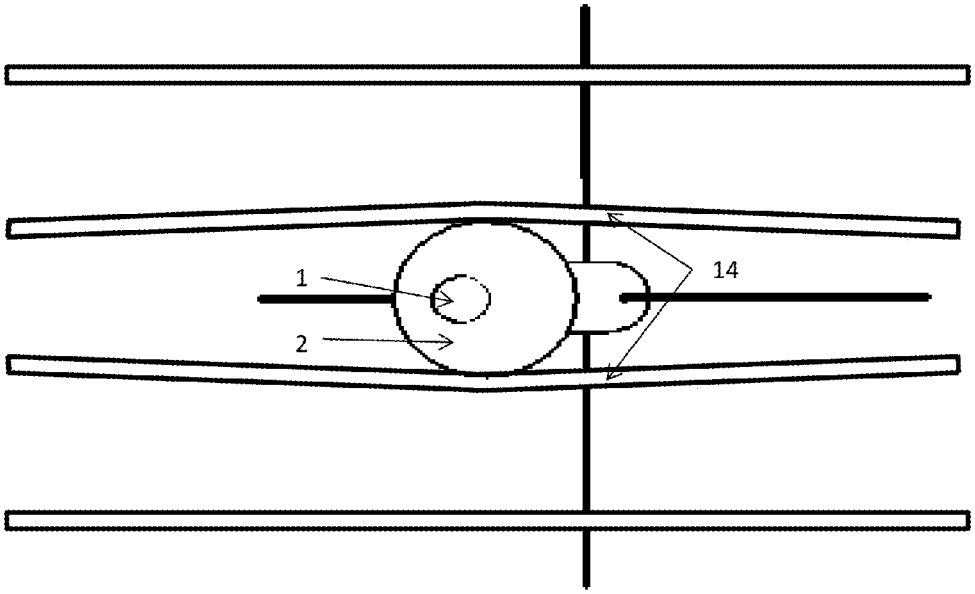

FIG. 7 shows a front view of an RPG passing through bar armor. The nosepiece 1 shown has passed through the plane of the bars 14 and the outer ogive 2 has contacted the bars and is exerting a lateral separating force on the bars. The bars are bent outward away from the ogive because of its conical shape. If the bars are of insufficient lateral strength they may not exert enough force to cause the desired deformation and dudding. To prevent this the bars must be made strong enough to minimize lateral spreading to acceptable limits, typically 0.1 inch-0.2 inch. This requires heavier bars and closer spacing between the bars than would be required if lateral spreading could be minimized through other means.

Figure 8:
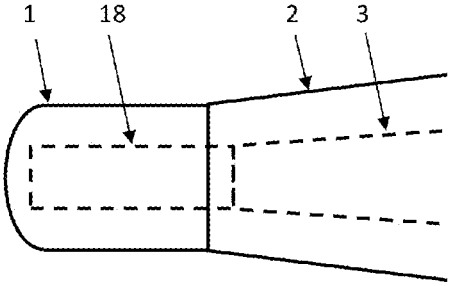
FIG. 8 is a depiction of the nosepiece of the RPG showing the critical internal elements.

FIG. 8 shows a close up of the nosepiece 1 of the RPG, the piezo crystal 18, the outer ogive 2, and the inner ogive 3. The nosepiece of the RPG is typically made of a hard aluminum alloy between 0.2 and 0.4 mm in thickness depending on manufacturer. If the nosepiece is crushed or indented into the piezo crystal, the piezo crystal will produce a voltage and cause the RPG to detonate. Typically, any contact of the nosepiece with the bar will result in a detonation.

The Invention

The invention consists of various means of providing cross-attachments between the bars of a bar armor system for the purpose of minimizing lateral bar spreading of the type shown in FIG. 7 without the cross-attachments themselves causing the RPG to detonate upon the RPG nosepiece striking them. This allows thinner bars to be used than would otherwise be the case, resulting in lighter weight, improved performance, improved visibility through the bars, and lower cost.

Figure 9:
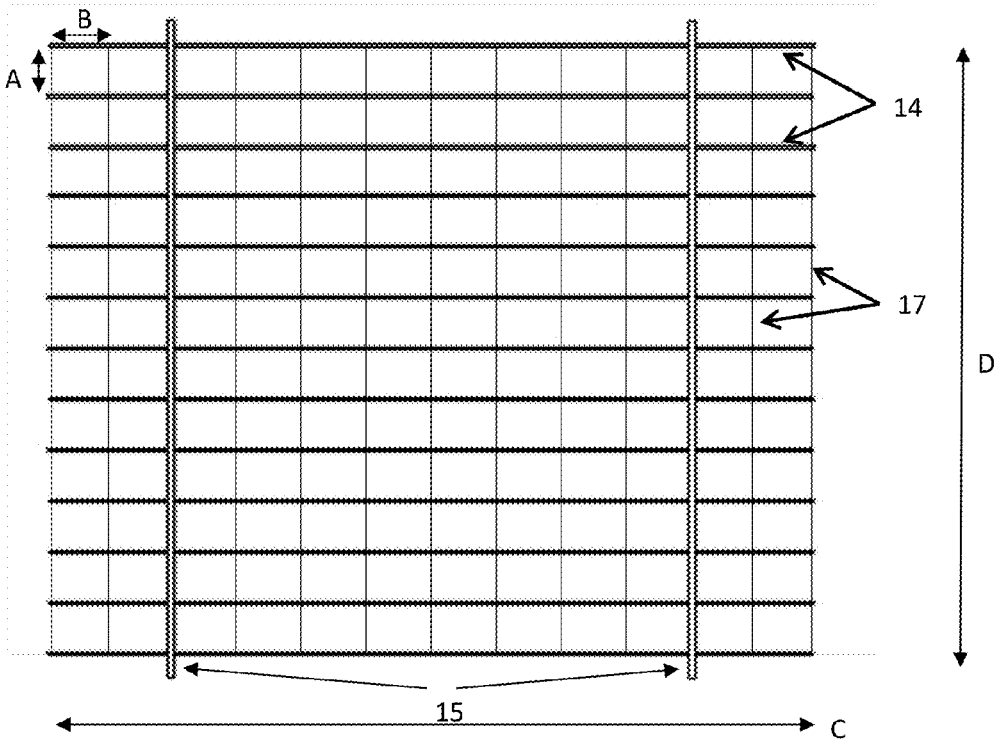
FIG. 9 is a depiction of cross-attachments on a bar armor system to prevent bar spreading.

FIG. 9 shows a front view of a basic embodiment of the invention. The bars 14 are cross-attached with thin high strength frangible cords 17 that prevent spreading between the bars as per FIG. 7. The space between the bars A is typically ~3 inches and the spacing between each cross-attachment B is 3 inches.

Figure 10:
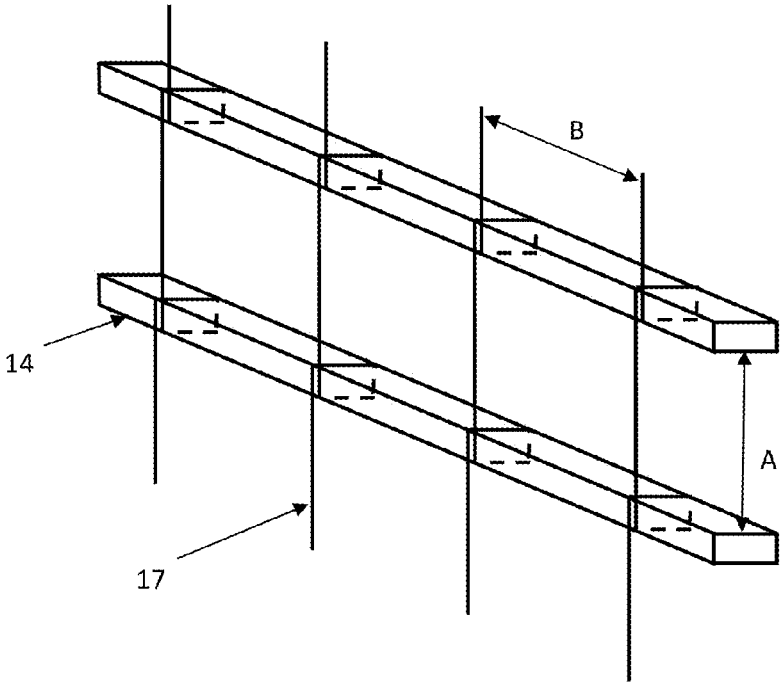
FIG. 10 is a depiction of a means of connecting the cross-attachments to the bars.

The overall length of the system C is typically between 3 feet and 4 feet and the height D is typically 3 feet to 4 feet. The cords are attached to each bar by wrapping them around each bar as is shown in FIG. 10 with a few pounds of tension to ensure tightness. Waterproof glue is then applied to the wrapped area to ensure adhesion. The glue prevents the cords from slipping and provides protection from abrasion for the wrapping. If abrasion is not an issue, the cords can be wrapped around the bars multiple times to prevent slippage. Because the bars no longer require high lateral strength, thinner bars may be used with various cross sections that, in addition to being lighter, provide advantages in effectiveness, visibility through the bars, and cost. It is estimated that the aluminum bars often used currently could be reduced in cross section from ½" tall×½" deep to ¼" tall×½" deep. This would result in a 50% weight saving and approximately 8% improvements in counter-RPG effectiveness and 7% in through-bar visibility.

The cross-attachment cords can be made of a variety of high strength materials such as Mason® Braided nylon string, Kevlar®, Spectra®, or other high strength fibers or polymers including high test fishing line such as 100 pound ANDE® Monster Monofilament Line. Acceptable cord diameters will depend on the strength and density of the cord material, but will generally be in the vicinity of 0.5 mm-2 mm. Thin flexible steel or high strength copper wires of roughly 0.1 mm-0.5 mm or steel braids such as Hillman® picture wire may also be used. Alternatively, tapes such as ¼" Scotch® reinforced mailing tapes may be used. This has the advantage of being self-adhesive. Cloths or ribbons of high strength material such as nylon or polyester can also be used. All these materials can also be made into bands 18 or loops 19 of the appropriate size that can be slipped over two adjacent bars and glued into place, as shown in FIG. 11. This may ease assembly of the system. In any case, the cross-attachments must have low enough areal density, typically less than 0.5 grams per inch, and sufficient frangibility to avoid indenting the nosepiece or shocking the piezoelectric crystal and detonating the RPG.

Appropriate glues include nearly any high-quality waterproof glue such as Gorilla Glue®, Liquid Nails®, or Duro® rubber sealant.

Cross section shapes can include rectangles, trapezoids, triangles, ovals, and Vs. Tapering the bar at the rear to form a trapezoid or triangle would save additional weight and aid the visibility at non-horizontal angles. Various bar materials may be used including high strength metals such as McMaster Carr 7075 aluminum bar stock, spring steel, or titanium alloy; composites such as carbon-fiber/epoxy; ceramic elements such as Coors® alumina; or combinations of these.

Another embodiment consists of closer spacing of the cross-attachments. This would potentially allow thinner cords to be used and could further reduce bar separation in the event that one of the cords is broken by the RPG. Spacings as close as one inch might be advantageous.

In another embodiment, fasteners or clamps 20 with nubs on the ends attached to each bar at 1"-3" spacings may be used as depicted in FIG. 12*a* (side view) and 12*b* (top view). These would be advantageous because they could avoid the necessity of wrapping the cross-attachments around the bars, which is time consuming when done by hand.

Yet another embodiment includes holes in the bars such that a cord or wire can be threaded through the bars and tied or welded into place.

Figure 13:
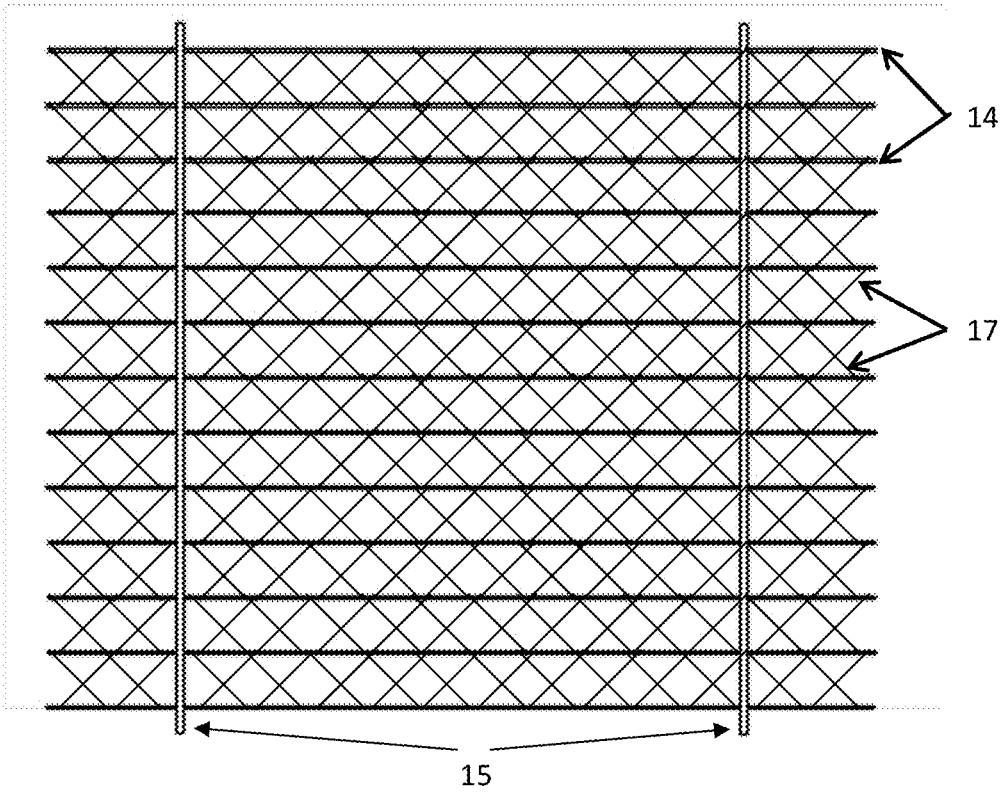
FIG. 13 is a depiction of an alternate configuration of cross-attachments.

In yet another embodiment, the cross-attachments may be attached non-perpendicularly. A criss-cross attachment pattern such as shown in FIG. 13 would have the same flexibilities as described above and would additionally provide improved lateral stability if the cords were in tension to prevent side-to-side sway of the bars. This could be useful in a system that had no metallic bar supports 15. The cords are wrapped around the bars similar to FIG. 10 and must be glued in place to prevent sideward slipping.

There are many possible embodiments of this invention. Nothing in the above examples is intended to limit the invention more narrowly than the appended claims. The examples are intended to be illustrative rather than exclusive.

What is claimed is:

1. An armor system for protecting against an incoming RPG or similarly fused threat comprising a plurality of parallel bar members wherein said bar members are separated from each other by a spacing, a plurality of bar supports perpendicular to and connected to the parallel bar members; and a plurality of low density, frangible (i.e., easily breakable) cross-attachment members connected to the parallel bar members, wherein said cross-attachment members are connected to the parallel bar members to permit penetration of a portion of the RPG through said bar members without setting off an explosive charge if the RPG strikes the cross-attachment members, wherein low density comprises areal density of less than 0.5 g/linear inch, and wherein said cross-attachment members are spaced and connected to said parallel bar members such that they provide mutual support to the bars to restrict expansion of said spacing by an ogive of the incoming RPG even if one or more of the cross-attachment members is severed by the RPG such that if the RPG nosepiece does not strike the bar member, the contact of the RPG ogive with the bars causes shorting of an RPG fuse circuit.

2. The armor system of claim 1 wherein the parallel bars are composed of various materials selected from the group consisting of: metals, ceramics, composites, and combinations thereof.

3. The armor system of claim 1 wherein the parallel bars are of various cross sections and shapes selected from the group consisting of: rectangles, trapezoids, triangles, ovals, and Vs.

4. The armor system of claim 1 wherein the low density, frangible cross-attachment members are selected from a group consisting of: cords, wires, braids, ribbons, cloths, and tapes.

5. The armor system of claim 1 wherein cross-attachment members are attached by methods selected from the group consisting of: tying, wrapping, braiding, gluing, welding, adhesion, fasteners, screws, nubs, clips, bands, and any combination thereof.

6. The armor system of claim 1 wherein the cross-attachment members are configured in a manner selected from the group consisting of: attachments that pass around the parallel bars, attachments that pass through holes in the parallel bars, perpendicular parallel bar-to-parallel bar attachments, X-shaped attachments, attachments between every other parallel bar, and combinations of these.

* * * * *